United States Patent [19]

Darlington

[11] 4,175,024

[45] Nov. 20, 1979

[54] ELECTROLYTIC CELL MEMBRANE SEALING MEANS

[75] Inventor: William B. Darlington, Portland, Tex.

[73] Assignee: PPG Industries, Inc., Pittsburgh, Pa.

[21] Appl. No.: 963,248

[22] Filed: Nov. 22, 1978

[51] Int. Cl.[2] ..... C25B 9/00; C25B 11/03; C25B 13/04

[52] U.S. Cl. ..... 204/252; 204/283; 204/288; 204/289; 204/295

[58] Field of Search ..... 204/252-258, 204/283, 267-270, 288-289, 295

[56] References Cited

U.S. PATENT DOCUMENTS

| | | | |
|---|---|---|---|
| 3,878,082 | 4/1975 | Gokhale | 204/256 X |
| 3,980,544 | 9/1976 | Adams et al. | 204/289 X |
| 4,093,525 | 6/1978 | Cunningham | 204/253 X |
| 4,110,191 | 8/1978 | Specht et al. | 204/263 X |
| 4,115,237 | 9/1978 | Woodard, Jr. et al. | 204/258 |

*Primary Examiner*—John H. Mack
*Assistant Examiner*—D. R. Valentine
*Attorney, Agent, or Firm*—Richard M. Goldman

[57] ABSTRACT

Disclosed is an electrolytic cell having electrode units of opposite polarity where each of the electrode units have fingered electrodes extending outwardly therefrom toward the electrode unit of opposite polarity. In this way, the electrodes are interleaved between electrodes of opposite polarity. At least one of the electrode units has a base plate with fingered electrodes mechanically and electrically connected thereto. The fingered electrodes bear a synthetic separator such as a microporous diaphragm or a permionic membrane thereon with lap at the base. The electrolytic cell is characterized by a fingered, interleaved electrode of the electrode unit of opposite polarity compressively bearing upon the lap, whereby to provide an electrolyte-tight seal.

9 Claims, 4 Drawing Figures

FIG. 1
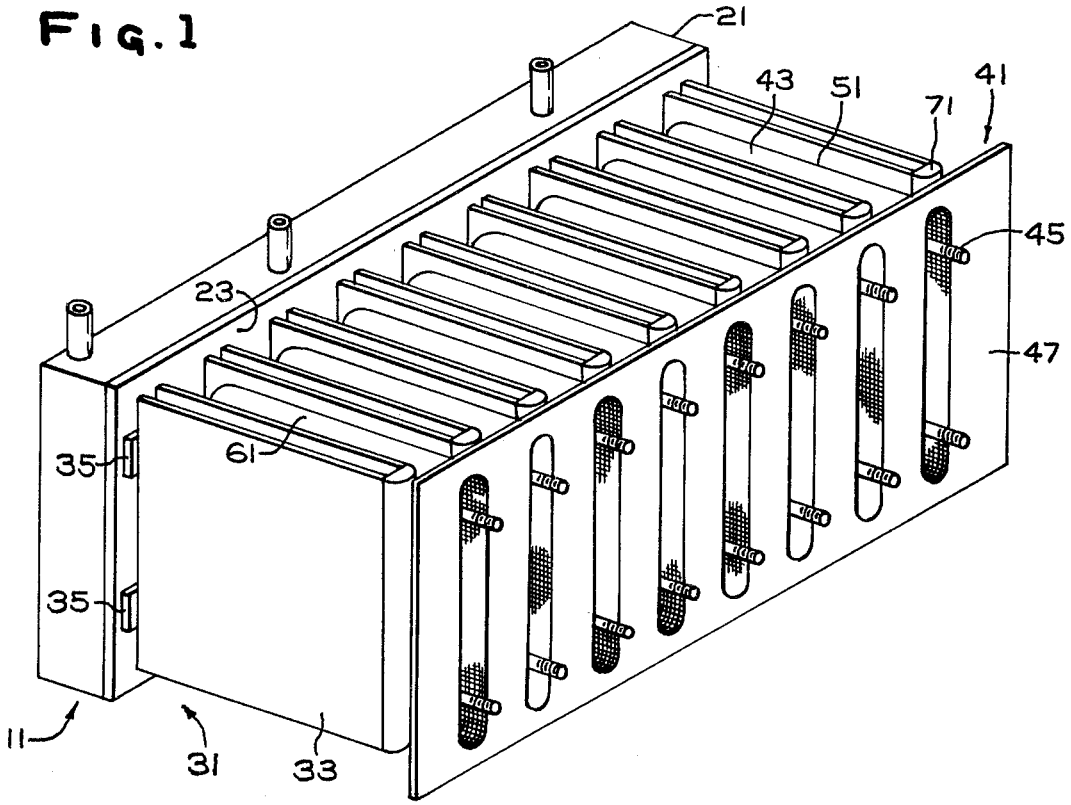
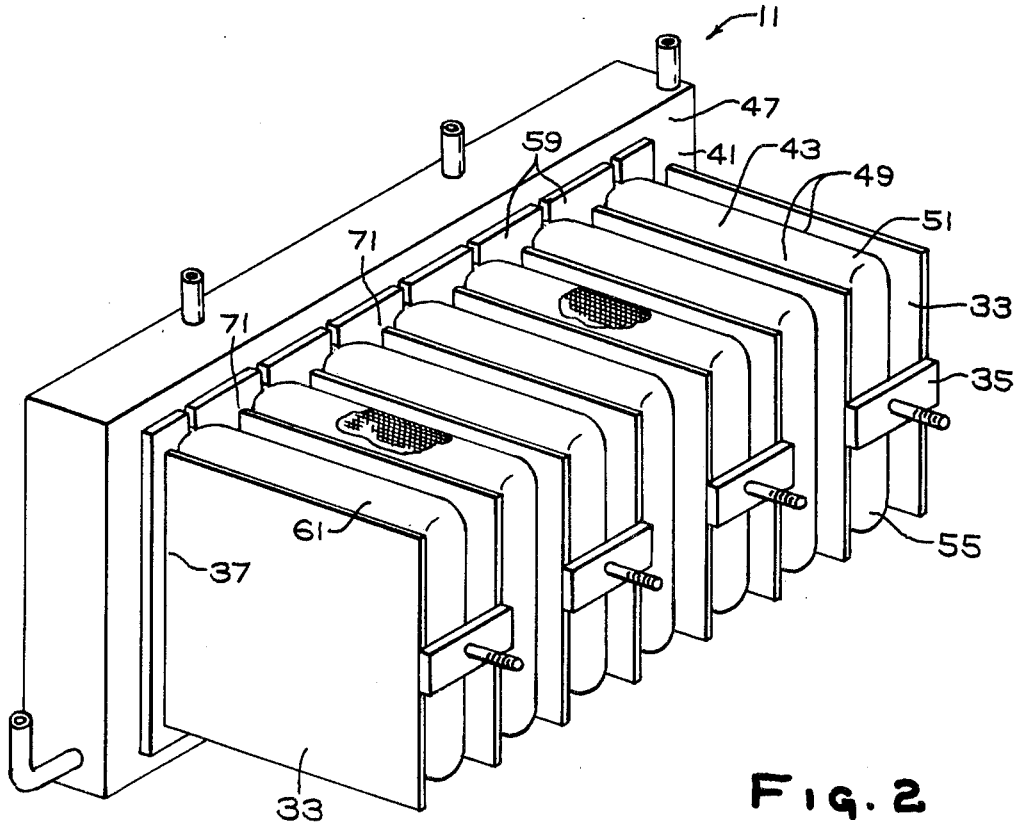
FIG. 2

ELECTROLYTIC CELL MEMBRANE SEALING MEANS

DESCRIPTION OF THE INVENTION

In the commercial manufacture of chlorine and alkali metal hydroxides, an electrolytic cell is utilized having an anolyte compartment and a catholyte compartment. The anolyte compartment has acidic anolyte at a pH of from about 2.5 to about 5.5 with chlorine being evolved at the anode. The catholyte compartment has an alkaline catholyte containing more than one mole per liter of alkali metal hydroxide with hydrogen being evolved at the cathode.

A separator separates the acidic anolyte from the alkaline catholyte. The separator may be a synthetic separator such as a microporous diaphragm or a permionic membrane. Microporous diaphragms, i.e., as microporous fluorocarbon films, allow chloride ion to diffuse through the separator, providing a cell liquor of alkali metal hydroxide and alkali metal chloride.

Alternatively, the synthetic separator may be a permionic membrane, i.e., as a cation selective permionic membrane. Cation selective permionic membranes useful in chlor-alkali electrolysis include fluorocarbon resins with pendant acid groups thereon such as carboxylic acid groups, sulfonic groups, phosphonic acid groups, phosphoric acid groups, derivatives thereof, and precursors thereof.

The prior art teaches the use of asbestos diaphragm deposited on an electrolyte permeable cathode. However, the use of synthetic separators such as fluorocarbon materials as described above is now preferred. Fluorocarbon materials useful in forming synthetic separators are difficult to form into the shapes necessary for banks of fingered electrodes, especially as contrasted to the vacuum deposition of asbestos from a slurry. The provision of many joints, seams, and convolutions requires high temperatures or strong reagents or both, both of which have a deleterious effect on electrodes. This is because the anodes have a catalytic coating thereon, as may the cathodes also. Additionally, the avoidance of such joints and seams provides a practical means of applying a membrane.

A particularly satisfactory design should be one providing an electrolyte tight seal while avoiding complex post-assembly seaming and joining. It has now been found that one particular satisfactory design utilizes an individual synthetic separator glove for each membrane-bearing electrode. The glove has laps at the open edges of the membrane at the electrode base. These laps overlap and are held in compression by compressive means supported by the interleaved electrodes of opposite polarity.

THE FIGURES

FIG. 1 is a perspective view of the internal components of an electrolytic cell looking toward the anodic unit.

FIG. 2 is a perspective view of the internal components of an electrolytic cell locking toward the cathodic unit.

DETAILED DESCRIPTION OF THE INVENTION

Figure 3:
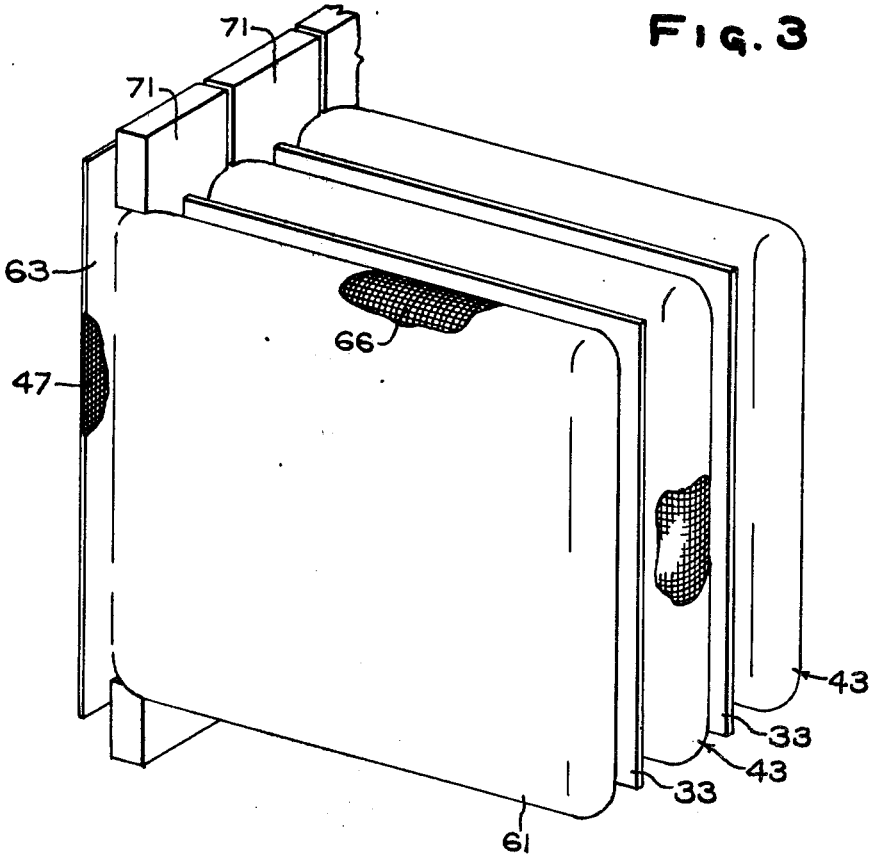
FIG. 3 is a perspective view showing the cathodes with synthetic separators thereon, laps at the bases thereof, and anodes with compressive surfaces at the ends, the compressive surfaces bearing on the separator laps.
Figure 4:
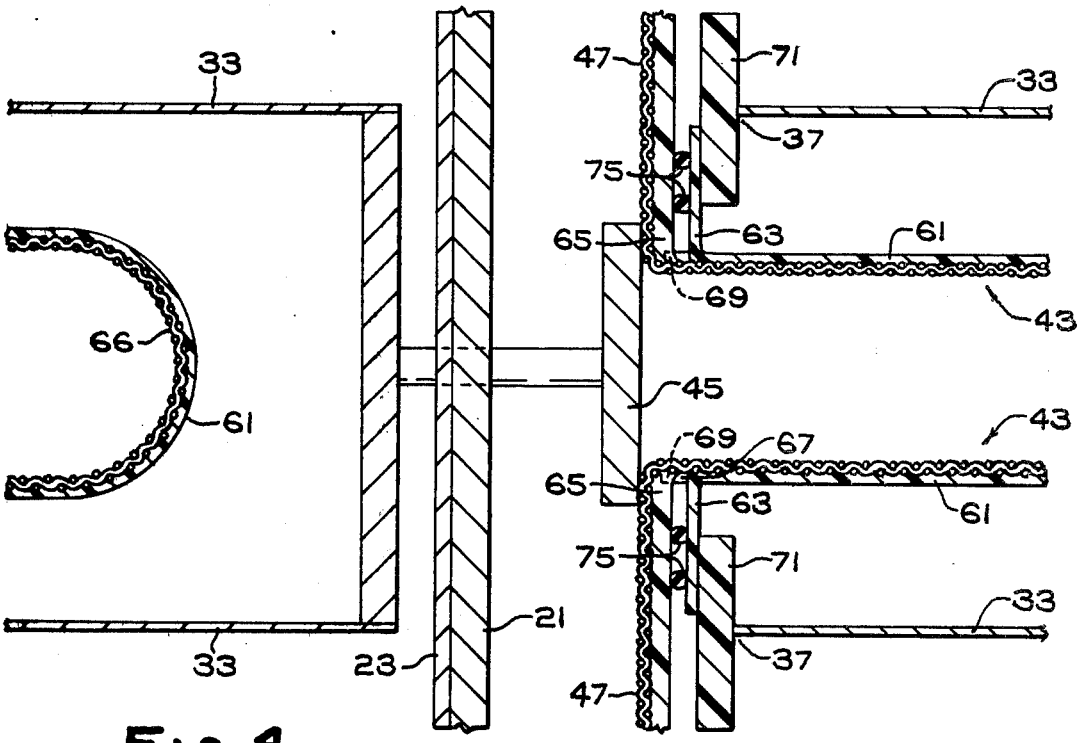
FIG. 4 is a cutaway top view of a bipolar electrolyzer.

The figures show a bipolar electrolyzer 1 having individual bipolar units 11, 13, 15. Each bipolar unit has a backplate 21 with a valve metal lining 23 on the anodic side and walls 25, including side walls top and bottom.

The bipolar unit 11 includes anodic unit 31 having anode blades 33 extending outwardly from the valve metal lining 23 of the backplate 21. Alternatively, the anode blades 33 may extend outwardly from anode supports 35 which in turn extend outwardly from the valve metal lining 23 of the backplate 21.

The bipolar unit 11 has a cathodic unit 41 having cathode fingers 43 which extend outwardly from the opposite side of the backplate 21 with valleys between adjacent cathode fingers 43. Electrical conductors 45 provide electrical connection between the backplate 21 and the cathode fingers 43. The interior of the cathode fingers 43 and the back screen 47 provide one common electrolyte compartment, i.e., a catholyte compartment. While a "backscreen" is referred to, it is to be understood that the backscreen 47 may be either permeable or impermeable to the electrolyte.

The cathode fingers 43 may be individually removable through elastic clips as shown in U.S. Pat. No. 4,016,604. Alternatively, they may be permanently joined to the back screen 47.

According to a still further exemplification, the cathodes can be a single blade or porous body inside a hollow membrane support. Alternatively, the cathodes may be in the form of a pair of walls 49 closed at the top 51, bottom 53, and leading edge 55, and open at the trailing edge 57 to communicate with the volume between the backplate 21 and the back screen 47.

The walls 49 can have means for spacing the membrane 61 therefrom while supporting the membrane 61. For example, the membrane 61 can be supported by and spaced from the cathode 13 by fins, blades, or the like.

While the bipolar unit 11 is described with anode unit 31 having blade-like electrodes 33 in the electrolyte, and cathode fingers 43 bearing the synthetic separator 61, it is to be understood that the structural roles and functions of the anode and cathode can be reversed with the cathodes being blades or plates extending into the electrolyte from a back plate and the anodes being hollow structures bearing the separator 61. According to a still further exemplification, both the anodes and the cathodes can be hollow structures bearing the separator 61.

The individual separator gloves 61 are maintained on the cathode fingers 43 by bearing means, i.e., compressive means 71, on the leading edge of the opposite electrodes 33. The opposite electrodes are generally the anodes 33 and are between pairs of hollow cathode elements 43. But, as described above, the opposite electrodes could also be the cathodes with hollow anodes bearing the synthetic separator.

The synthetic separator 61, that is, the membrane or microporous diaphragm, bears upon cathode finger 43, and the lap 63 at the open edge of synthetic separator glove bears upon the cathodic back screen 47. The laps 63 are compressed against the back screen 47 by a bearing surface 71 on the leading edge 37 of the anode blades 33.

The compressive surface 71 may be joined to the anode by mechanical means and may be a ceramic, a polymeric, or a non-catalytic metallic member. For example, the bearing or compressive surface may be fabricated of an uncoated valve metal. The compressive surfaces may be T- or L-shaped members of the anode blade 33, as a T welded onto or bent into the anode blade 33 or an L welded onto or bent into the anode blade 33. The compressive surface 71 can be formed by a pair of anode blades 33, 33 forming one anode and bent in the form of a U or V, or welded to a U or V, or welded parallel to each other with a cross member at the leading edge. In the exemplification thus described, the U or V formed by the loading edges 37, or the cross member joining the leading edges 37 bears on the separator 61.

In one exemplification, the laps 63 overlap and are sealed, for example, between cathode fingers 43 by the bearing surface 71.

In an alternative exemplification, there is a liner 65 on the back screen 47 with the laps 63 laying on the liner 65. In a particularly preferred embodiment of this exemplification, the liner 65 has lips 67 to provide both a further seal and a compressible surface for the compressive means 71 to bear upon.

In a still further alternative exemplification, there is a liner 65 on the back screen 47 with the liner 65 laying atop the laps 63 and being held in compression by compressive means 71, thereby to provide a seal.

In a still further embodiment of the seal of the exemplification described above, there may be sealing means, e.g., O-rings or gaskets, 75 interposed between a pair of overlapping laps 63 or between the liner 65 and an overlap 63.

According to this invention the synthetic separator 61 can be in the form of separate envelopes for each finger with joints at this top 65, bottom 66, and leading edge 68, and lap 63 at the trailing edge 69. Thereby the seals or seams can be welded, sewn, heated, or produced by chemical reaction prior to placing the individual gloves or envelopes on individual electrodes. Alternatively the individual fingers may be unitary envelopes, produced for example, by casting, blow molding, or injection molding.

While the structure of this invention has been described with respect to certain exemplifications and embodiments thereof, it is not intended to be so limited but only as in the claims appended hereto.

I claim:

1. In an electrolytic cell having two electrode units of opposite polarity, each of said electrode units having fingered electrodes extending outwardly toward the electrode unit of opposite polarity whereby the electrodes are interleaved between electrodes of opposite polarity, at least one of said electrode units comprising a base plate, foraminous fingered electrodes mechanically and electrically connected to the base plate, said fingered electrodes bearing an enveloping synthetic separator and a back screen parallel to and spaced from the base plate, the improvement comprising:

(a) said synthetic separator having a lap bearing upon said back screen; and (b) the fingered, interleaved electrodes of the electrode unit of opposite polarity compressively bearing upon said lap whereby to provide an electrolyte tight seal.

2. The electrolytic cell of claim 1 wherein the electrode bearing the synthetic separator is an alkali resistor cathode.

3. The electrolytic cell of claim 1 wherein the electrode bearing the synthetic separator is an acidified brine resistor anode.

4. The electrolytic cell of claim 1 wherein the synthetic separator is a cation selective permionic membrane.

5. The electrolytic cell of claim 1 wherein the synthetic separator is a microporous diaphragm.

6. The electrolytic cell of claim 1 wherein said back screen has a compressible liner thereon and said separator has a lap which either overlies or underlies said compressible liner, and wherein the fingered, interleaved electrodes of the electrode unit of opposite polarity compressively bear upon said lap whereby to provide an electrolyte tight seal between said liner and synthetic separator.

7. The electrolytic cell of claim 6 wherein the lap of the synthetic separator lays atop the back screen liner.

8. The electrolytic cell of claim 6 wherein the back screen liner lays atop the lap of the synthetic separator.

9. The electrolytic cell of claim 6 wherein sealing means are interposed between said back screen liner and the separator laps.

* * * * *